US007059794B2

(12) United States Patent
Weeks et al.

(10) Patent No.: US 7,059,794 B2
(45) Date of Patent: Jun. 13, 2006

(54) METHODS AND APPARATUS FOR BURSTING PERFORATED PAPER STOCK

(75) Inventors: David E. Weeks, Willseyville, NY (US); Bruce Harris, Freeville, NY (US); Steven P. Hilsdorf, Willseyville, NY (US)

(73) Assignee: TransAct Technologies Incorporated, Wallingford, CT (US)

( * ) Notice: Subject to any disclaimer, the term of this patent is extended or adjusted under 35 U.S.C. 154(b) by 79 days.

(21) Appl. No.: 10/878,835

(22) Filed: Jun. 28, 2004

(65) Prior Publication Data

US 2005/0286955 A1 Dec. 29, 2005

(51) Int. Cl.
*B26F 3/00* (2006.01)

(52) U.S. Cl. ..... 400/621; 400/621.2; 225/1; 225/4; 225/6; 225/10

(58) Field of Classification Search ..... 225/1, 225/4, 6, 9, 10, 11; 400/621, 621.1, 621.2
See application file for complete search history.

(56) References Cited

U.S. PATENT DOCUMENTS

| | | | | |
|---|---|---|---|---|
| 4,261,497 | A * | 4/1981 | Roetter et al. | 225/100 |
| 4,454,973 | A * | 6/1984 | Irvine | 225/100 |
| 4,529,114 | A * | 7/1985 | Casper et al. | 225/100 |
| 4,572,686 | A | 2/1986 | Tanaka | |
| 5,141,142 | A * | 8/1992 | Ramsey | 225/4 |
| 5,215,393 | A | 6/1993 | Wincent | |
| 5,223,940 | A | 6/1993 | Matsumoto | |
| 5,452,959 | A * | 9/1995 | Oka | 400/149 |
| 5,622,302 | A * | 4/1997 | Ring | 225/4 |
| 5,785,224 | A * | 7/1998 | Nowakowski | 225/4 |
| 5,833,380 | A | 11/1998 | Hosomi et al. | |
| 5,949,525 | A * | 9/1999 | Nishimura | 355/40 |
| 6,056,460 | A * | 5/2000 | Suzuki | 400/621 |
| 6,338,436 | B1 | 1/2002 | Iguchi et al. | |
| 6,341,861 | B1 | 1/2002 | Sasaki | |
| 6,352,381 | B1 * | 3/2002 | Gonmori et al. | 400/615.2 |
| 6,447,186 | B1 * | 9/2002 | Oguchi et al. | 400/621 |
| 6,575,090 | B1 | 6/2003 | Vienneau et al. | |
| 6,602,008 | B1 * | 8/2003 | Yamagishi et al. | 400/619 |
| 2004/0000572 | A1 * | 1/2004 | Engelhardt et al. | 225/1 |
| 2004/0132529 | A1 | 7/2004 | Mkrtchyan et al. | |

* cited by examiner

*Primary Examiner*—Andrew H. Hirshfeld
*Assistant Examiner*—Dave A. Ghatt
(74) *Attorney, Agent, or Firm*—Lipsitz & McAllister, LLC

(57) ABSTRACT

Methods and apparatus for bursting perforated paper stock are provided. A feed mechanism is provided for feeding perforated paper stock in a feed direction along a paper path in a printer. The perforated paper stock has sections separated by perforations. A loop area is provided in the printer for accumulating one of the sections of the perforated paper stock. A burst element is provided for bursting a perforation of the accumulated section. In order to burst the perforation of the accumulated section, the feed direction is reversed to draw the perforation of the accumulated section against the burst element, thereby separating the section from the perforated paper stock. A paper dispensing mechanism is provided for advancing the separated section out of the loop area and dispensing the section from the printer.

28 Claims, 3 Drawing Sheets

METHODS AND APPARATUS FOR BURSTING PERFORATED PAPER STOCK

BACKGROUND OF THE INVENTION

The present invention relates generally to the field of printing. More specifically, the present invention relates to methods and apparatus for bursting (i.e., separating) perforated paper stock in a printer. For example, the present invention is particularly adapted for bursting perforated ticket stock in a ticket printer.

High speed printers, such as inkjet, thermal, dye sublimation and dot matrix printers are used to provide vouchers, coupons, tickets, receipts and the like (hereinafter generically referred to as "tickets") to consumers. Such tickets are usually made of paper, onto which text and/or graphics are printed, but may alternatively be made of any other flexible substrate that can be fed through the printer transport mechanism. The tickets may be provided in rolls of ticket stock with perforations separating the individual tickets in the roll of ticket stock. Typically, after a ticket is printed, it is separated from the ticket stock by a process commonly referred to as "bursting", which refers to separating the printed ticket from the ticket stock at the perforation. After the bursting process, the ticket may be discharged to the consumer for example, via a bezel mounted in the front panel of a self-service terminal. Such terminals can be found, for example, in casinos (e.g., slot machines), retail establishments (e.g., lottery machines), transportation centers (e.g., train, bus and subway ticket machines), gasoline service stations (pump receipts), and the like.

One problem that sometimes arises when dispensing tickets to consumers is that the customer attempts to remove the ticket from the bezel or output slot of the printer before printing is complete and/or before bursting has occurred. This situation can arise in printers where the ticket is partially output either during the printing process or before bursting has completed, for example due to the fact that the paper path is shorter than the length of the ticket.

It would be advantageous to provide methods and apparatus for bursting perforated paper stock in which bursting occurs prior to making the printed section available for receipt by the customer.

The methods and apparatus of the present invention provide the foregoing and other advantages.

SUMMARY OF THE INVENTION

The present invention relates to methods and apparatus for bursting perforated paper stock in a printer. In an example embodiment of the invention, an apparatus for bursting perforated paper stock is provided. The apparatus includes a feed mechanism for feeding perforated paper stock in a feed direction along a paper path in a printer. The perforated paper stock has sections separated by perforations. A loop area is provided in the printer for accumulating one of the sections of the perforated paper stock. A burst element is provided for bursting of a perforation of the accumulated section. In order to burst the perforation of the accumulated section, the feed direction is reversed to draw the perforation of the accumulated section against the burst element, thereby separating the section from the perforated paper stock. A paper dispensing mechanism is provided for advancing the separated section out of the loop area and dispensing the section from the printer.

A sensor may be provided for sensing whether the accumulated section was successfully separated from the perforated paper stock during the bursting. In the event that the section was not successfully separated from the perforated paper stock during bursting, the feed direction of the perforated paper stock may be reversed while the section is simultaneously advanced out of the loop area in order to impart tension to the section to cause bursting of the perforation.

The section of perforated paper stock may be fed past a print head of the printer prior to bursting. Alternatively, the section of perforated paper stock may be fed past a print head of the printer subsequent to bursting. In other words, with the present invention, the section may be printed first and then separated from the perforated paper stock, or separated first and then printed.

The burst element may comprise a stationary element, for example the burst element may comprise a stationary burst bar. The burst bar may be wedge shaped.

Depending on the length of the section of perforated paper stock, the section may loop back on itself as it accumulates in the loop area. For example, the loop area should be large enough to accommodate a loop in the perforated paper stock such that the perforated paper stock is not creased or folded as it accumulates in the loop area.

The dispensing mechanism may comprise exit drive rollers, for example a pair of oppositely disposed exit drive rollers for feeding the section therebetween as is commonly known in the art. The section of perforated paper stock may be fed through the loop area and between the exit drive rollers before accumulating in the loop area. The exit drive rollers may prevent the dispensing of the section of perforated paper stock from the printer until the bursting of the perforation has been completed.

In an alternative embodiment, the exit drive rollers may partially dispense the section of perforated paper and hold the section until the bursting of the perforation, thereby preventing the section from being pulled out of the printer prematurely.

The printer may comprise a ticket printer. The sections of perforated paper stock may comprise tickets. For example, the ticket printer may comprise a slot machine ticket printer, a gaming machine ticket printer, a point of sale ticket printer, a lottery machine ticket printer, a ticket printer for a transportation ticket vending machine, or a ticket printer for an entertainment ticket vending machine. The perforated paper stock may be comprised of any type of flexible substrate used for printing, such as paper, cardstock, plastic (e.g., cellophane or Mylar), laminates, metal foil, and the like, as long as the substrate can be fed through the printer transport mechanism and is suitable for printing.

The present invention also includes methods for bursting perforated paper stock corresponding to the foregoing apparatus.

BRIEF DESCRIPTION OF THE DRAWINGS

The present invention will hereinafter be described in conjunction with the appended drawing figures, wherein like numerals denote like elements, and.

DETAILED DESCRIPTION

The ensuing detailed description provides preferred exemplary embodiments only, and is not intended to limit the scope, applicability, or configuration of the invention. Rather, the ensuing detailed description of the preferred exemplary embodiments will provide those skilled in the art with an enabling description for implementing a preferred embodiment of the invention. It should be understood that various changes may be made in the function and arrangement of elements without departing from the spirit and scope of the invention as set forth in the appended claims.

Figure 1:
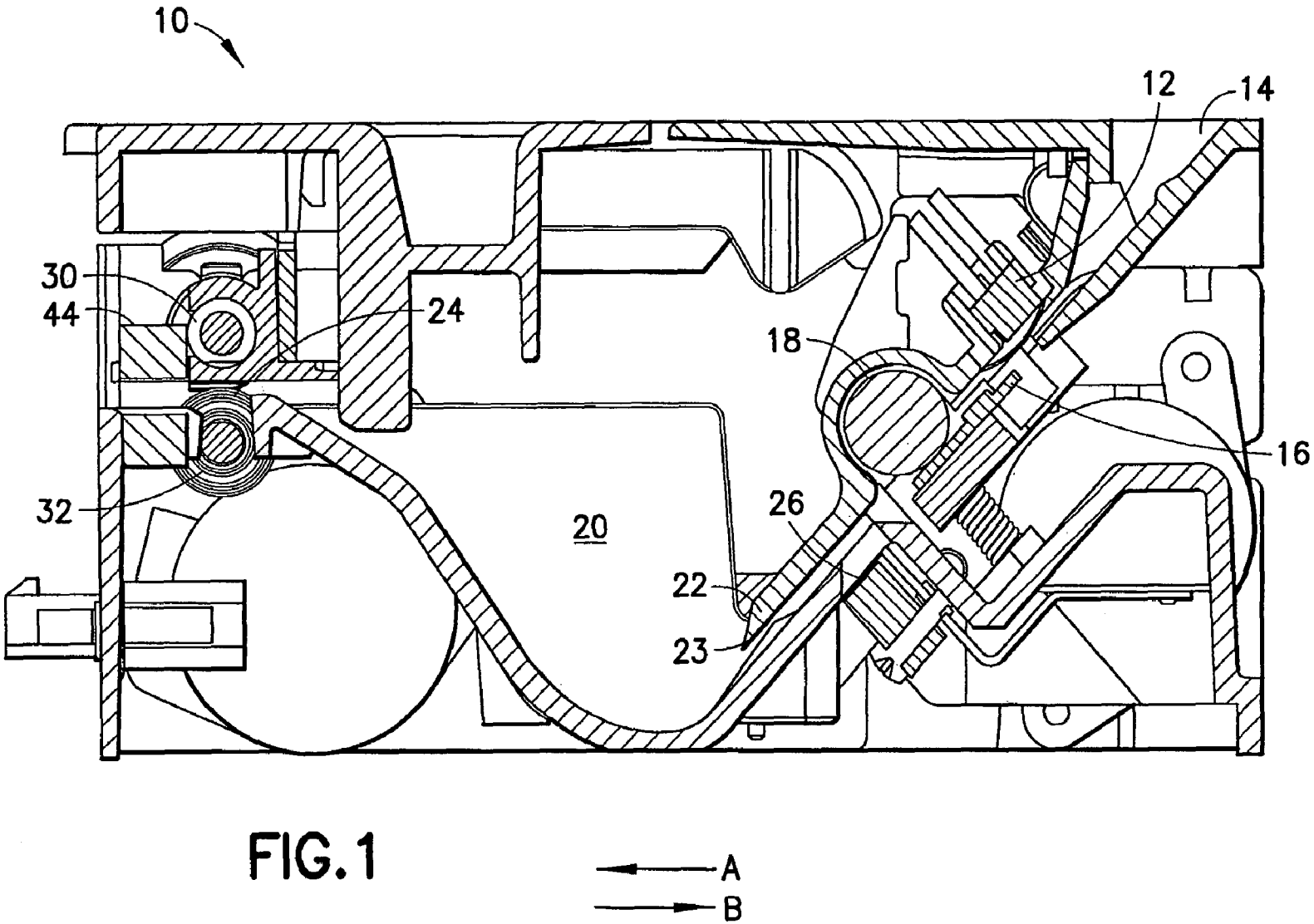
FIG. 1 shows an example embodiment of a printer in accordance with the present invention.

An example embodiment of the invention is shown in FIG. 1. The apparatus includes a feed mechanism for feeding perforated paper stock in a feed direction (shown by arrow A) along a paper path in a printer 10. The perforated paper stock may be held in a paper tray of the printer (not shown) as is commonly known in the art. Perforated paper from the paper tray is fed into a ticket entrance 14 and past the printing mechanism (e.g., print head 16 and platen 18). In the embodiment shown, the platen 18 also acts as the feed mechanism for feeding the perforated paper past the print head 16. The perforated paper stock has sections separated by perforations. A loop area 20 is provided in the printer 10 for accumulating one of the sections of the perforated paper stock. A burst element 22 is provided for bursting of a perforation of the accumulated section. In order to burst the perforation of the accumulated section, the feed direction is reversed (shown by arrow B) to draw the perforation of the accumulated section against the burst element 22, thereby separating the section from the perforated paper stock. A paper dispensing mechanism 24 is provided for advancing the separated section out of the loop area 20 and dispensing the section from the printer 10.

A burst sensor 26 may be provided for sensing whether the accumulated section was successfully separated from the perforated paper stock during the bursting. In the event that the section was not successfully separated from the perforated paper stock during bursting, the feed direction (arrow A) of the perforated paper stock may be reversed (arrow B) while the section is simultaneously advanced out of the loop area by the dispensing mechanism 24 in order to impart tension to the section to cause bursting of the perforation.

FIG. 1 shows an example embodiment in which the section of perforated paper stock is fed past a print head 16 of the printer 10 prior to bursting. Alternatively, the section of perforated paper stock may be fed past a print head 16 of the printer 10 subsequent to bursting. In other words, the section may be printed first and then separated from the perforated paper stock, or separated first and then printed.

The burst element 22 may comprise a stationary element, for example the burst element may comprise a stationary burst bar. The burst bar may have a wedge shaped tip 23.

Figure 2A:
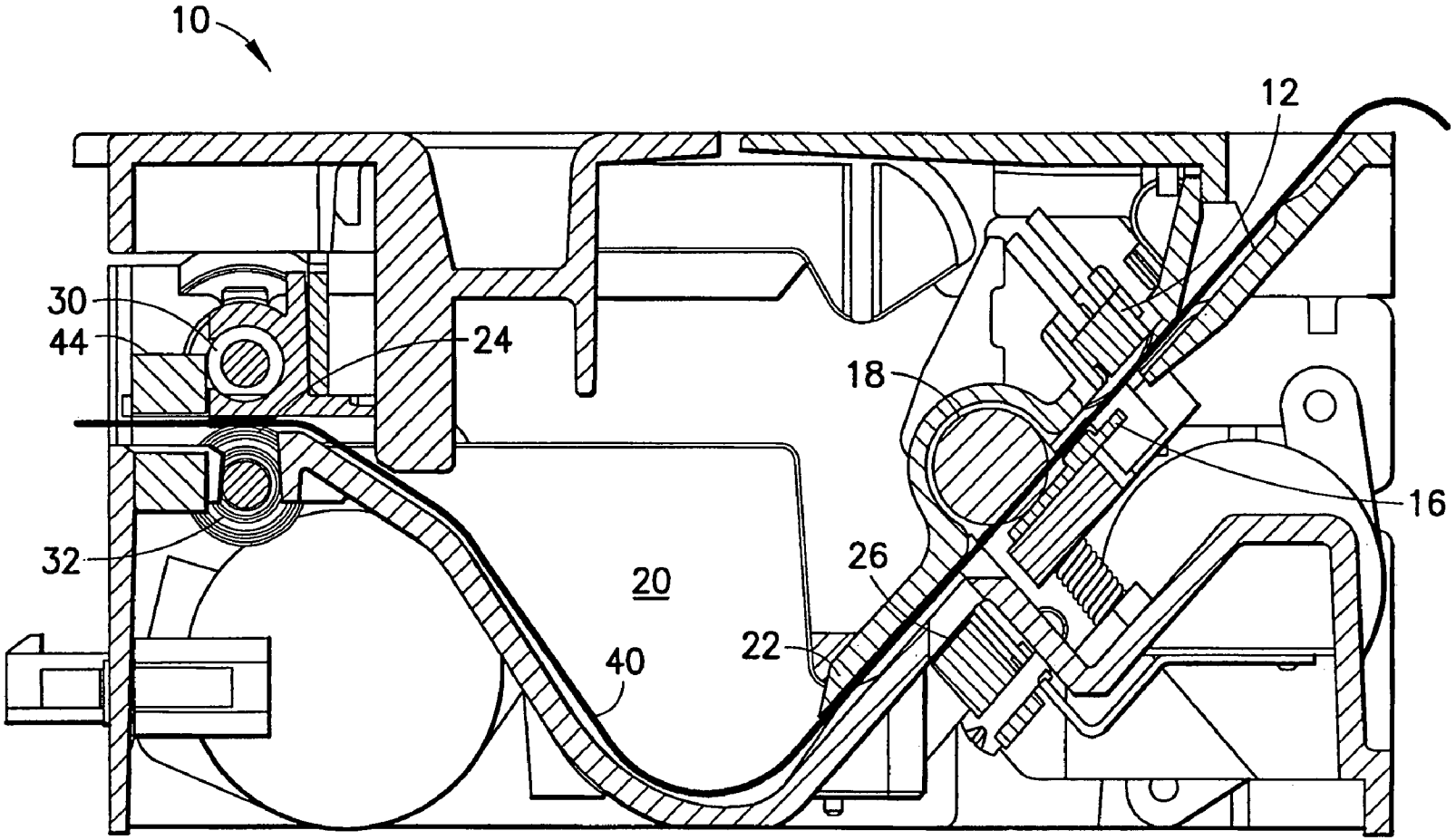
FIGS. 2 (2A and 2B) shows the paper path through the example embodiment of the printer of FIG. 1.
Figure 2B:
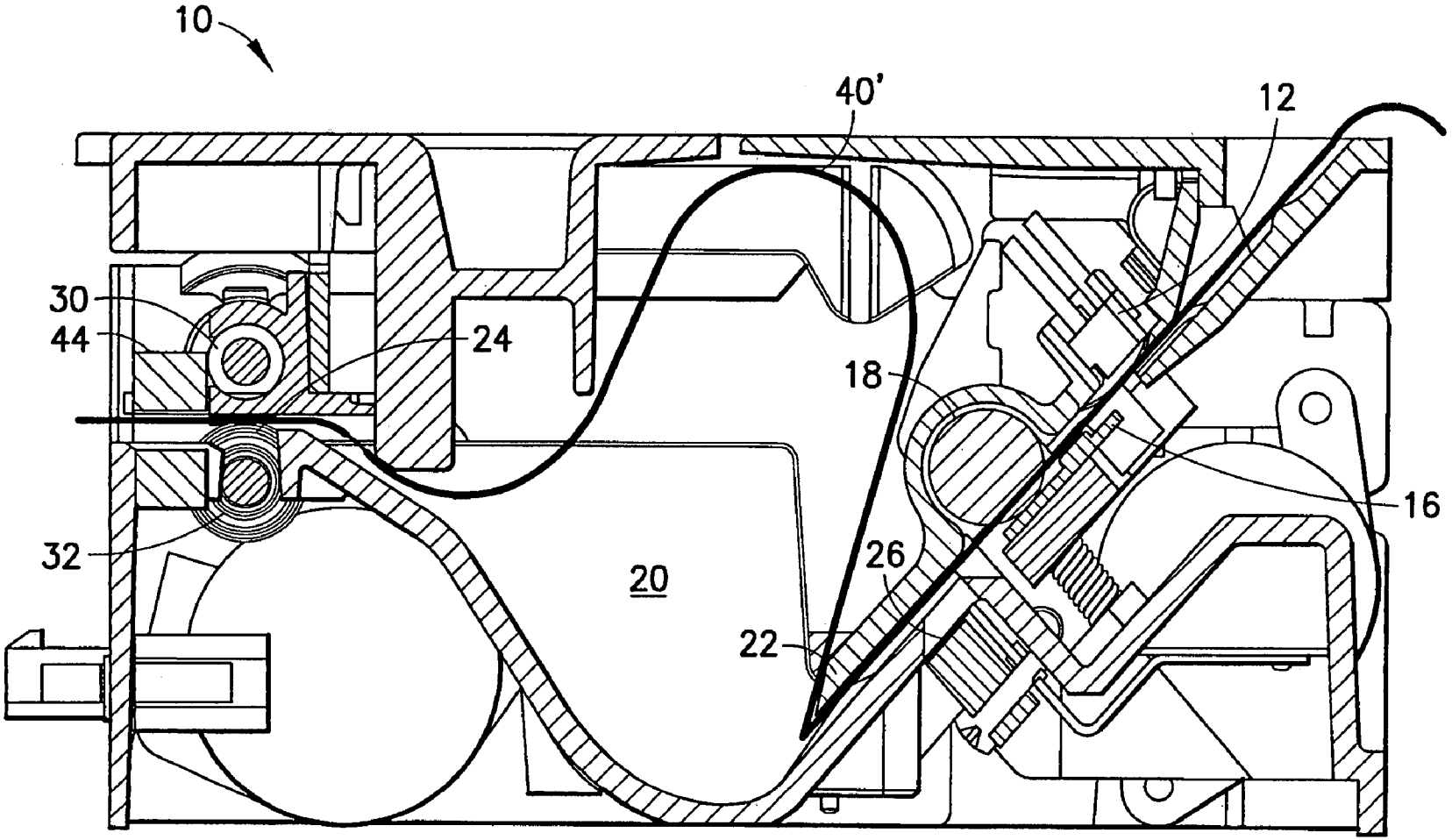

FIGS. 2A and 2B show the paper path through the printer 10 in accordance with the present invention. The perforated paper is fed from the paper tray into the ticket entrance 14 (FIG. 1) and along a paper path 40, as shown in FIG. 2A. The perforated paper is fed past the print head 16 and platen 18. A top of form sensor 12 may be provided prior to the print head 16 to sense the presence of the leading edge of the paper stock. The perforated paper is then fed past the burst element 22 and into the loop area 20. Initially, as shown in FIG. 2A, the paper path 40 of the perforated paper stock will follow the contours of the bottom portion of the loop area 20 until the leading edge of the perforated paper stock reaches the paper dispensing mechanism 24. The perforated paper stock may then be held by the paper dispensing mechanism while the section of perforated paper is fed into the loop area 20 as printing is completed. Depending on the length of the section of perforated paper stock, the section may loop back on itself as it accumulates in the loop area 20 prior to bursting, as shown by the paper path 40' in FIG. 2B. Therefore, the loop area 20 should be large enough to accommodate a loop in the perforated paper stock such that the perforated paper stock is not creased or folded as it is fed into the loop area 20.

The dispensing mechanism 24 may comprise exit drive rollers, for example a pair of oppositely disposed exit drive rollers 30, 32 for feeding the section therebetween as is commonly known in the art. The section of perforated paper stock may be fed through the loop area 20 and between the exit drive rollers 30, 32 before accumulating in the loop area 20. The exit drive rollers 30, 32 may prevent the dispensing of the section of perforated paper stock from the printer 10 until the bursting of the perforation has been completed.

In an alternative embodiment, the exit drive rollers 30, 32 may partially dispense the section of perforated paper and hold the section until the bursting of the perforation, thereby preventing the section from being pulled out of the printer prematurely. In such an embodiment, it would be advantageous if the section of perforated paper is partially dispensed from the exit rollers 30, 32 such that the section of perforated paper stock does not extend past an output slot of the printer such that it is unavailable to a customer until after bursting occurs.

The printer 10 may comprise a ticket printer. The sections of perforated paper stock may comprise tickets. For example, the ticket printer may comprise a slot machine ticket printer, a gaming machine ticket printer, a point of sale ticket printer (e.g., a cash register, an automated gasoline pump, a vending machine, an automated banking machine, or the like), a lottery machine ticket printer, a ticket printer for a transportation ticket vending machine, or a ticket printer for an entertainment ticket vending machine. The ticket may comprise a receipt, a lottery ticket, a bus ticket, an airplane ticket, a train ticket, a gaming voucher, a slot machine voucher, or the like.

A sensor 44 may be provided adjacent the output slot of the printer for sensing when the ticket or substrate has been removed from the output slot.

The perforated paper stock may be comprised of any type of flexible substrate used for printing, such as paper, cardstock, plastic (e.g., cellophane or Mylar), laminates, metal foil, and the like, as long as the substrate can be fed through the printer transport mechanism and is suitable for printing.

It should now be appreciated that the present invention provides advantageous methods and apparatus for bursting perforated paper stock in a printer.

Although the invention has been described in connection with various illustrated embodiments, numerous modifications and adaptations may be made thereto without departing from the spirit and scope of the invention as set forth in the claims.

What is claimed is:

1. A method for bursting perforated paper stock, comprising:

feeding perforated paper stock in a feed direction along a paper path in a printer, said perforated paper stock having sections separated by perforations;

accumulating one of said sections of said perforated paper stock in a loop area;

reversing said feed direction to draw a perforation of said accumulated section against a burst element causing bursting of said perforation thereby separating said section from said perforated paper stock; and advancing said separated section out of said loop area and dispensing said section from said printer.

2. A method in accordance with claim 1, further comprising:

sensing whether said section was successfully separated from said perforated paper stock during said bursting.

3. A method in accordance with claim 2, wherein:

in the event that said section was not successfully separated from said perforated paper stock during said bursting, said method further comprises:

reversing the feed direction of said perforated paper stock while simultaneously advancing said section out of said loop area in order to impart tension to said section to cause said bursting.

4. A method in accordance with claim 1, wherein:

said section of perforated paper stock is fed past a print head of the printer prior to said bursting.

5. A method in accordance with claim 1, wherein:

said section of perforated paper stock is fed past a print head of the printer subsequent to said bursting.

6. A method in accordance with claim 1, wherein:

said burst element comprises a stationary element.

7. A method in accordance with claim 1, wherein:

said burst element comprises a stationary burst bar.

8. A method in accordance with claim 7, wherein:

said burst bar is wedge shaped.

9. A method in accordance with claim 1, wherein:

said section of perforated paper stock loops back on itself as it accumulates in the loop area.

10. A method in accordance with claim 1, wherein:

said section of perforated paper stock is fed through the loop area and between exit drive rollers before accumulating in said loop area.

11. A method in accordance with claim 10, wherein:

said exit drive rollers prevent said dispensing of said section of perforated paper stock from said printer until said bursting of said perforation.

12. A method in accordance with claim 10, wherein:

said exit drive rollers partially dispense said section of perforated paper and hold said section until said bursting of said perforation.

13. A method in accordance with claim 1, wherein:

said printer comprises a ticket printer; and said sections of perforated paper stock comprise tickets.

14. A method in accordance with claim 13, wherein:

said ticket printer comprises one of a slot machine ticket printer, a gaming machine ticket printer, a point of sale ticket printer, a lottery machine ticket printer, a ticket printer for a transportation ticket vending machine, or a ticket printer for an entertainment ticket vending machine.

15. Apparatus for bursting perforated paper stock, comprising:

a feed mechanism for feeding perforated paper stock in a feed direction along a paper path in a printer, said perforated paper stock having sections separated by perforations;

a loop area for accumulating one of said sections of said perforated paper stock;

a burst element for bursting of a perforation of said accumulated section and separating said section from said perforated paper stock when said feed direction is reversed to draw said perforation against said burst element; and a paper dispensing mechanism for advancing said separated section out of said loop area and dispensing said section from said printer.

16. Apparatus in accordance with claim 15, further comprising:

a sensor for sensing whether said section was successfully separated from said perforated paper stock during said bursting.

17. Apparatus in accordance with claim 16, wherein:

in the event that said section was not successfully separated from said perforated paper stock during said bursting, the feed direction of said perforated paper stock is reversed while said section is simultaneously advanced out of said loop area in order to impart tension to said section to cause said bursting.

18. Apparatus in accordance with claim 15, wherein:

said section of perforated paper stock is fed past a print head of the printer prior to said bursting.

19. Apparatus in accordance with claim 15, wherein:

said section of perforated paper stock is fed past a print head of the printer subsequent to said bursting.

20. Apparatus in accordance with claim 15, wherein:

said burst element comprises a stationary element.

21. Apparatus in accordance with claim 15, wherein:

said burst element comprises a stationary burst bar.

22. Apparatus in accordance with claim 21, wherein:

said burst bar is wedge shaped.

23. Apparatus in accordance with claim 15, wherein:

said section of perforated paper stock loops back on itself as it accumulates in the loop area.

24. Apparatus in accordance with claim 15, wherein:

said dispensing mechanism comprises exit drive rollers; and said section of perforated paper stock is fed through the loop area and between said exit drive rollers before accumulating in said loop area.

25. Apparatus in accordance with claim 24, wherein:

said exit drive rollers prevent said dispensing of said section of perforated paper stock from said printer until said bursting of said perforation.

26. Apparatus in accordance with claim 24, wherein:

said exit drive rollers partially dispense said section of perforated paper and hold said section until said bursting of said perforation.

27. Apparatus in accordance with claim 15, wherein:

said printer comprises a ticket printer; and said sections of perforated paper stock comprise tickets.

28. Apparatus in accordance with claim 27, wherein:

said ticket printer comprises one of a slot machine ticket printer, a gaming machine ticket printer, a point of sale ticket printer, a lottery machine ticket printer, a ticket printer for a transportation ticket vending machine, or a ticket printer for an entertainment ticket vending machine.

* * * * *